United States Patent [19]

Otterson

[11] 4,308,979

[45] Jan. 5, 1982

[54] PRE-ORIENTED ROTOR-TYPE DISPENSER TOP

[75] Inventor: Lewis L. Otterson, Chagrin Falls, Ohio

[73] Assignee: Weatherchem Corporation, Twinsburg, Ohio

[21] Appl. No.: 101,094

[22] Filed: Dec. 7, 1979

[51] Int. Cl.[3] ..... B65D 47/06

[52] U.S. Cl. ..... 222/516; 220/253; 222/548; 222/554

[58] Field of Search ..... 222/142.9, 153, 480, 222/484, 485, 486, 512, 516, 548, 554, 565; 220/253; 239/394

[56] References Cited

U.S. PATENT DOCUMENTS

| | | | |
|---|---|---|---|
| 2,780,395 | 2/1957 | Schlabach et al. | 222/548 X |
| 3,104,039 | 9/1963 | Dike | 222/548 X |
| 3,297,198 | 1/1967 | Wright, Jr. | 221/5 |
| 3,317,093 | 5/1967 | Moran | 222/548 X |

FOREIGN PATENT DOCUMENTS

| | | | |
|---|---|---|---|
| 48631 | 4/1934 | Denmark | 222/548 |

*Primary Examiner*—Robert J. Spar
*Assistant Examiner*—Fred A. Silverberg
*Attorney, Agent, or Firm*—Pearne, Gordon, Sessions, McCoy & Granger

[57] ABSTRACT

The rotatable cap of an end closure and the associated end closure base are provided with detent elements defining one rotative position out of the entire 360 degrees and allowing rotation up to such position from all other rotative positions throughout the entire 360 degrees. The detent may be in the form of a plug which is received in and closes the discharge opening of the closure to act as an anti-sifting element. Automatic orientation can be accomplished by simply engaging the cap with a friction member carried at the end of a power-driven spindle provided with a slip clutch while turning the spindle through at least one full turn.

1 Claim, 9 Drawing Figures

FIG. 1
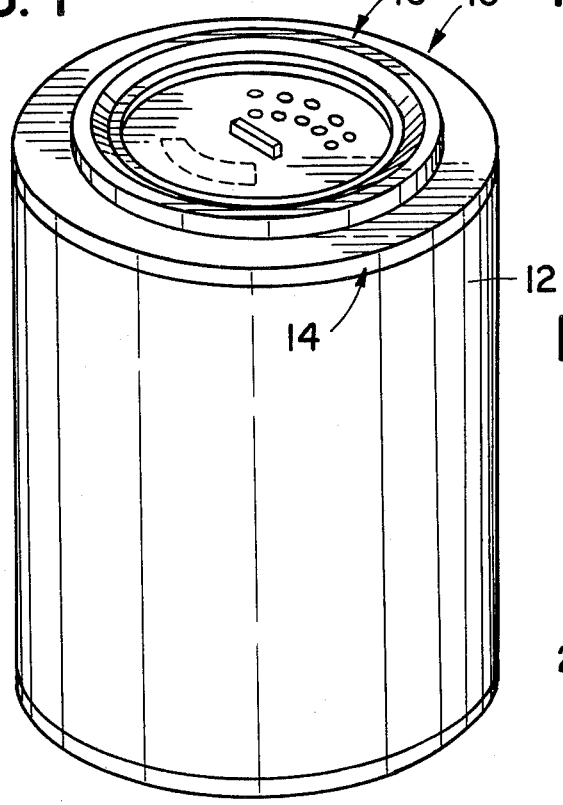
FIG. 2
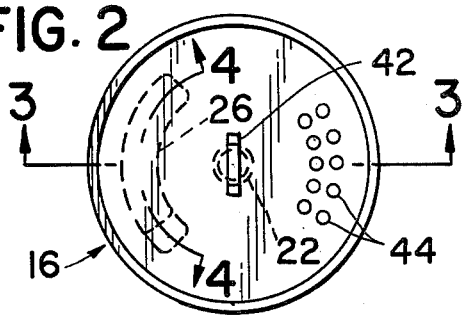
FIG. 3
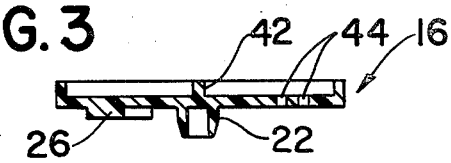
FIG. 4
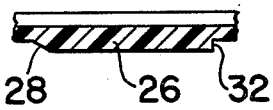
FIG. 7
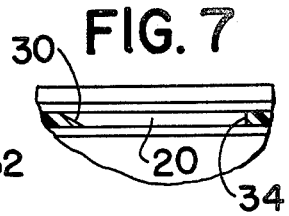
FIG. 8
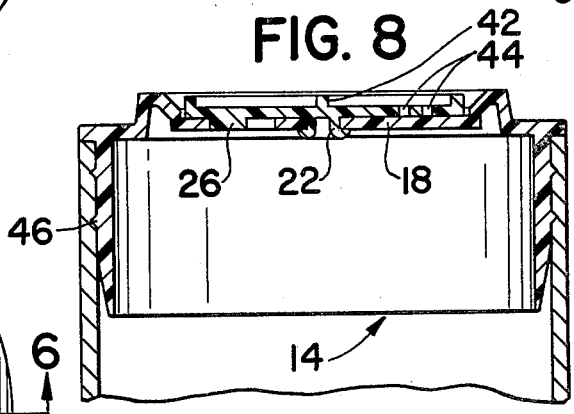
FIG. 5
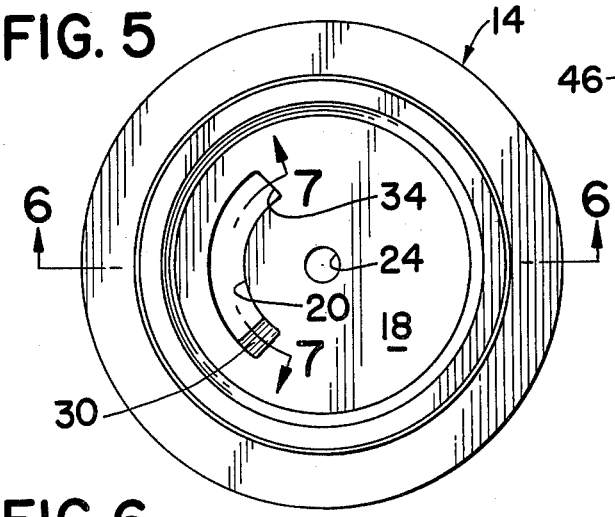
FIG. 6
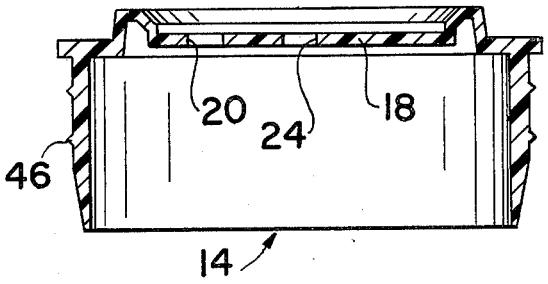
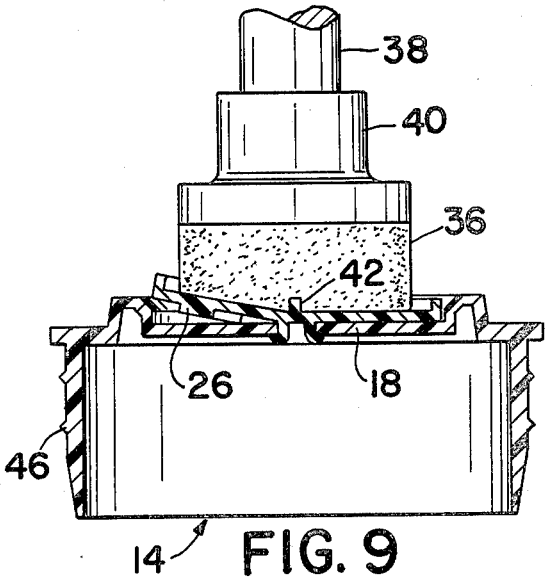
FIG. 9

PRE-ORIENTED ROTOR-TYPE DISPENSER TOP

This invention relates to plastic end closures for containers, and more particularly to two-piece end closures which include a stationary base and a rotatable cap.

Some prior end closures of this type have not been provided with any detents for defining the plurality of intended rotative positions of the rotatable cap (closed position and one or more open, or dispensing, positions). Examples of such closures without detents are shown in U.S. Pat. Nos. 3,841,053; 3,851,792; and 3,851,812. Other prior art end closures of this type have been provided with detents to define the plurality of intended rotative positions. Examples of such closures with detents are shown in U.S. Pat. Nos. 2,961,133; 3,100,589; and 3,104,039.

The present invention departs from these and other prior art end closures by providing a single detent which, out of the entire 360 degrees through which the rotatable cap can turn, defines only one position of the rotating element. The invention also contemplates elimination of any pre-positioning or post-positioning step for proper assembly of the closure base and the rotatable cap, and thereby accomplishes simplification of assembly procedures.

The invention will be more fully understood from the following description of a specific example.

In the drawings:

FIG. 1 is an isometric view of an end closure embodying the invention mounted on a cylindrical container.

FIG. 2 is a plan view of the rotatable cap of the end closure seen in FIG. 1 prior to its assembly with its associaed base.

FIG. 3 is a section taken on the plane defined by line 3—3 in FIG. 2.

FIG. 4 is a fragmentary section taken on the cylindrical surface defined by line 4—4 in FIG. 2.

FIG. 5 is a plan view of the base of the end closure seen in FIG. 1.

FIG. 6 is a view taken on the line defined by line 6—6 in FIG. 5.

FIG. 7 is a fragmentary section taken on the cylindrical surface defined by line 7—7 in FIG. 5.

FIG. 8 is a vertical cross section of the assembled end closure, together with the top portion of the container seen in FIG. 1.

FIG. 9 is a vertical cross section of the end closure at an intermediate stage in the assembly of the cap and base, the closure being shown in association with assembling apparatus. The plane on which the cross section of FIG. 9 is taken differs from that of the other cross sectional views of the base, and the cap is in a different rotative position.

Shown in the drawings is an end closure 10 for a cylindrical container 12. The end closure comprises a stationary base 14 adapted to be friction fitted in the container 12, as shown in FIG. 8, or to be glued in, screwed on, welded to, or otherwise affixed to a container. The end closure also includes a generally flat-bottomed cap 16 which is rotatably mounted on the base 14.

The base 14 has a central flat web portion 18, with a discharge opening 20 (FIGS. 5-7) formed at one side thereof. A rotative connection is formed by a sleeve or boss 22 (FIG. 3) and a mating opening 24 (FIG. 6) in the web portion 18 by positioning the boss in the opening and upsetting the free end in the manner seen in FIG. 8. The resulting rotative interconnection tends to snugly retain the bottom surface of the flat-bottomed cap 16 in face-to-face contact with the top surface of the central flat web portion 18 of the base.

A plug 26 (FIGS. 2-4, 8, 9) depends from the flat bottom of the rotatable cap 16. The plug 26 is preferably of a configuration to fill the discharge opening 20. One end of the plug may be relieved, as at 28 (FIG. 4), to form a ramp, and a corresponding ramp 30 may be formed at one end of the discharge opening 20. The other end of the plug may form a shoulder 32 which abuts the end edge 34 of discharge opening 20 when the plug 20 is in register with the discharge opening 20. When the plug 26 is out of register with the discharge opening 20, one side of the cap 16 is resiliently deformed upwardly so that the plug may ride on the top of the central flat web portion, as seen in FIG. 9.

When the cap is urged in a clockwise direction as viewed from the top, the shoulder 32 and edge 34 resist rotation of the cap at one rotative position—namely, when the plug 26 is in full register with the discharge opening 20—and allow rotation up to that one position from all other rotative positions throughout the entire 360 degrees.

When the stationary base 14 and rotatable cap 16 are assembled with the boss 22 upset against the bottom of the central flat web portion, the parts may be in any relative rotative position. With the parts still supported on an assembling apparatus (not shown), the cap can then be automatically oriented to the closed position simply by releasably urging the cap through one complete rotation of 360 degrees in the clockwise direction, as viewed from the top, so as to assure that shoulder 32 is brought into detent engagement with the edge 34. This may be accomplished by contacting the supported assembly from above with a deformable sponge driving pad 36 carried on a retractable power-rotated spindle 38 and driven thereby through a slip clutch 40. The clutch transmits sufficient torque to rotate the cap 16 to the detent position, and then slips when detent engagement occurs and until the power-rotated spindle is withdrawn.

The assembly shown in FIG. 9 may be one of an array of closure assemblies which are simultaneously formed in ganged assembly apparatus (not shown) and the spindle 38 and elements driven thereby may be one of a gang of similar spindles and elements arranged to drive the array of closure assemblies.

When the end user wants to open the closure, the cap 16 is rotated in the counterclockwise direction to cause the relief ramp 28 in the plug 26 to ride up on the ramp 30, or on the upper side edge of the corresponding end of discharge opening 20 if no ramp 30 is provided. As turning motion continues, the plug 26 rides on the upper surface of the central flat web portion 18, in a manner similar to that shown in FIG. 9. Rotation is continued until the dispensing holes 44 on the cap register with the discharge opening 20. In order to give the end user some purchase to readily turn the cap, a handle or rib 42 may be provided on the top side of the cap 16 at the center thereof or elsewhere.

The engagement at the ramps 28 and 30 resists rotation more than does the sliding engagement between the plug 26 and top surface of web portion 18 as seen in FIG. 9. Accordingly, automatic positioning may be accomplished as described above even by driving the cap in a counterclockwise direction providing that the slip clutch is capable of reliably discriminating between the relatively small torque necessary to drive the cap in rotation when the parts are as in FIG. 9 and the greater torque required to wedge the plug upward on the ramp 28 by advancing the cap from the closed position. The slip clutch must, of course, transmit the smaller of these torques and not the greater.

It may be preferred, however, to utilize a more positive means of positioning by detent action, as by reliance on engagement between shoulder 32 and edge 34 as first described.

If ramps 28 and 30 are not provided, so that the corresponding ends of plug 26 and discharge opening 20 are vertical similarly to the shoulder 26 and end edge 34, a suitable gripping tab (not shown) may be provided extending upwardly and then radially outwardly from the outer rim of the rotatable flat-bottomed cap 16 so that the end user can grasp the top and lift and rotate the cap from the closed condition seen in FIG. 8 to an open condition such as that seen in FIG. 9.

In the closed position of the illustrated end closure, the plug 26 is received in the discharge opening 20. This helps prevent sifting of powdery contents from the container, and represents an important advantage of a preferred form of the invention which is illustrated. However, the detent contemplated by the invention does not necessarily comprise a plug received in a discharge opening, but may comprise any suitable non-central single projection on the bottom of the cap 16 or top of the web portion 18 and cooperating non-central single depression on the other of such elements 16 or 18. The single detent may define any desired position of the cap on the base, whether closed or open to a single open position or to one of several alternate open positions. The closure may be used with orifices incorporated for either receiving or dispensing products. One or many types of orifices can be incorporated in one device, depending in part on the orifice size and surface area of mating parts. The illustrated closure is provided with anchor ribs (FIG. 6) for frictional engagement with fiberboard walls of a container 12, but the closure may be glued in also or alternatively screwed in, welded to, or otherwise affixed to various kinds of containers using various types of materials. The closure may be circular, square, or other shape, but the top piece must be capable of turning through a full turn around a center of rotation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A two-piece end closure for a container comprising a stationary base for attachment to the container, said base having a central flat web portion, a discharge opening in said central flat web portion at one side thereof, a generally flat-bottomed cap rotatably mounted over said central web portion of said base for selectively covering and opening said discharge opening, a rotative interconnection between said cap and said base at the center of said flat web portion of said base and tending to snugly retain the bottom surface of said generally flat-bottomed cap against the top surface of said central flat web portion of said base in face-to-face contact therewith, a plug depending from said flat bottom of said rotatable cap and, at one rotative position of said cap, projecting into a socket in said flat wall portion to thereby act as a detent against rotation to define one rotative position of said end closure, said cap being resiliently deformable from said face-to-face contact to allow said plug to ride on the top surface of said central web portion at all other rotative positions of said cap, said end closure as so constructed providing means for detentive resisting of rotation of the cap at said one rotative position out of the entire 360 degrees and allowing rotation free of detentive resistance up to said one position from all other rotative positions throughout the entire 360 degrees, said rotatable cap being of circular shape whereby a circular area of said top surface of said central flat web portion of said base is overlain by said cap in all rotative positions of said cap to thereby, throughout said circular area, shield said base from contact from above by any rotating member brought down into driving contact with said cap and thus limit driving contact, by any such member, to contact with said cap to the exclusion of said base, the sides of said plug and socket having substantially vertical walls abutting in one direction of rotation and having angular ramps wedging one upon the other for disengagement of the plug from the socket in the other direction of rotation, said socket and said discharge opening being one and the same, said one rotative position being the closed position of said end closure.

* * * * *